US006295980B1

(12) United States Patent
Lopez et al.

(10) Patent No.: US 6,295,980 B1
(45) Date of Patent: Oct. 2, 2001

(54) COMPOSITE POLYMER MANIFOLD FOR WATER HEATING UNIT

(75) Inventors: Fulton J. Lopez, Camarillo; M. Reza Afshar, Westlake Village, both of CA (US)

(73) Assignee: PacFab, Inc., Moorpark, CA (US)

( * ) Notice: Subject to any disclaimer, the term of this patent is extended or adjusted under 35 U.S.C. 154(b) by 0 days.

(21) Appl. No.: 09/612,638

(22) Filed: Jul. 7, 2000

Related U.S. Application Data

(60) Provisional application No. 60/175,714, filed on Jan. 12, 2000.

(51) Int. Cl.[7] ..... F24H 1/00

(52) U.S. Cl. ..... 126/344; 122/18.4; 122/367.1; 165/173

(58) Field of Search ..... 122/367.1, 18.4; 165/173, 905; 126/344

(56) References Cited

U.S. PATENT DOCUMENTS

| | | | | |
|---|---|---|---|---|
| 4,856,824 | * | 8/1989 | Clausen | 285/124.1 |
| 5,138,007 | | 8/1992 | Meister . | |
| 5,178,211 | * | 1/1993 | Bauer et al. | 165/173 |
| 5,318,007 | * | 6/1994 | Afshar | 126/350 R |
| 6,026,804 | * | 2/2000 | Schardt et al. | 126/344 |

* cited by examiner

*Primary Examiner*—Jiping Lu
(74) *Attorney, Agent, or Firm*—Pearne & Gordon LLP

(57) ABSTRACT

A header for a heat exchanger having a plurality of parallel hollow tubes mounted between a pair of flat mounting plates and defining a plurality of passages through the plates. The header comprises a tubular elongated body portion having an outer surface and an interior cavity. The body portion is provided with a plurality of parallel, hollow ports projecting from the outer surface to provide fluid communication between the passages and the cavity. The projecting ports space the header from the tube plate so that the header body remains relatively cool. This permits the header to be made from a plastic material.

29 Claims, 7 Drawing Sheets

COMPOSITE POLYMER MANIFOLD FOR WATER HEATING UNIT

This application claims priority based on U.S. Provisional Patent Application Ser. No. 60/175,714, filed Jan. 12, 2000.

BACKGROUND OF THE INVENTION

1. Field of the Invention

This invention relates generally to liquid heaters and particularly to swimming pool and spa heaters, which transfer heat from products of combustion to water as it is being circulated through a heat exchanger.

2. Description of the Prior Art

Water heaters for swimming pools or spas generally comprise a burner unit, an insulated combustion chamber above the burner, and a heat exchanger above the insulated combustion chamber for facilitating heat transfer between heated air in the insulated combustion chamber and water contained in the heat exchanger. A heat exchanger header manifold is provided at one end of the heat exchanger to connect water inlet and outlet ports to a plurality of water tubes in the heat exchanger. A return header is provided at the tube ends located at another end of the heat exchanger.

Typically, the manifold header and the return manifold are made from cast iron or brass to withstand the high temperature and pressure conditions. The design of these prior art headers results in a relatively large area of surface-to-surface contact between the header and manifold and the tube supporting plate at each end of the heat exchanger. Such an arrangement is shown in U.S. Pat. No. 5,138,007. As is set forth in that patent, prior art headers reached temperatures necessitating the use of copper or other high temperature piping material for the last several feet of piping leading to the header, in place of less expensive plastic piping.

While the invention defined in the aforementioned patent permits the use of direct plastic piping connections to the manifold, the use of metallic materials for the manifold headers and return manifolds have distinct disadvantages. Those materials add considerable weight to the unit, thereby increasing handling and shipping costs. Further, as noted above, the relatively large area of surface-to-surface contact between the tube supporting plates and the headers causes the transfer of heat to the headers. Relatively cool water flowing through the manifold header results in condensation which, when mixed with low pH combustion gases, can be corrosive to the metal structure of the heating unit and other internal components.

Attempts have been made to overcome these problems by fabricating the manifold header from plastic to reduce manufacturing and shipping costs. The use of such headers has resulted in leaks and condensation within the heat exchanger. Even high temperature plastics may not be able to withstand the temperatures generated on internal components if large surface areas of the headers are in surface-to-surface contact with the tube supporting plate.

SUMMARY OF THE INVENTION

The present invention relates to improved manifold and return headers for a swimming pool or spa heater. The heater comprises a burner, an insulated combustion chamber above the burner, a heat exchanger assembly above the combustion chamber for facilitating heat transfer between heated air in the combustion chamber and a liquid contained in the heat exchanger assembly.

The heat exchanger assembly has a plurality of parallel, hollow tubes mounted between a pair of flat mounting plates and defining a plurality of fluid passages through the plates. The manifold header comprises a cylindrical or tubular, elongated body portion having an outer surface and an interior cavity. Interior partitions separate the cavity into a feed chamber, a return chamber, and an exit chamber. The body portion of the manifold header has a plurality of parallel, hollow ports projecting from its outer surface, which are sealed against one of the plates to provide fluid communication between the fluid passages of the hollow tubes and the header. The hollow ports contact the plates in zones that immediately surround the tubes so that the zone of contact is cooled by the fluid passing through the tube since the temperature of that fluid is less than the temperature of the plate in more remote areas. Also, the projecting ports tend to space the tubular body portion from the plate to avoid conductive heating of the body portion by the plate.

The manifold header is provided with a plurality of parallel hollow bosses, which project substantially tangentially from the tubular body portion and which have plate-engaging faces substantially coplanar with plate-engaging faces of the projecting ports. Bolts extend through the hollow bosses to affix the header to the plate.

The bosses are located in closely spaced adjacency to the ports so that minimal heat is transferred to the header. Since direct contact between the header and the plate is largely avoided, the header is constructed from engineered resin such as PBT reinforced with randomly dispersed glass fibers.

In like manner, the return header is constructed of fiber-reinforced plastic and comprises a tubular, elongated body portion having an outer surface and an interior cavity. An interior partition separates the cavity into a first chamber and a second chamber. The first chamber is connected by the heat exchanger tubes to the feed chamber and the return chamber of the header manifold and the second chamber is connected by the heat exchanger tubes to the return chamber and the exit chamber of the manifold header.

The body portion of the return header has a plurality of parallel, hollow ports projecting from its outer surface which are sealed to the other one of the tube mounting plates to provide fluid communication between the fluid passages of the hollow tubes and the cavity. The hollow ports contact the plate in zones which immediately surround the tubes so that the zone of contact is cooled by the fluid passing through the tube, since the temperature of the fluid is less than the temperature of the plate in more remote areas. Also, the projecting ports tend to space the tubular body portion from the plate to avoid conductive heating of the body portion by the plate.

The return header is also provided with a plurality of parallel, hollow bosses which project tangentially from the tubular body portion and which have plate-engaging faces substantially coplanar with the plate-engaging faces of the projecting ports. Bolts extend through the hollow bosses to affix the header to the plate. The bosses are located in closely spaced adjacency to the ports so that minimal heat is transferred to the header.

The heat exchanger assembly further includes a main manifold associated with the manifold header. The main manifold is plastic and serves to connect the manifold header to the pool or spa pump and to the pool or spa.

DETAILED DESCRIPTION OF THE INVENTION

Figure 1:
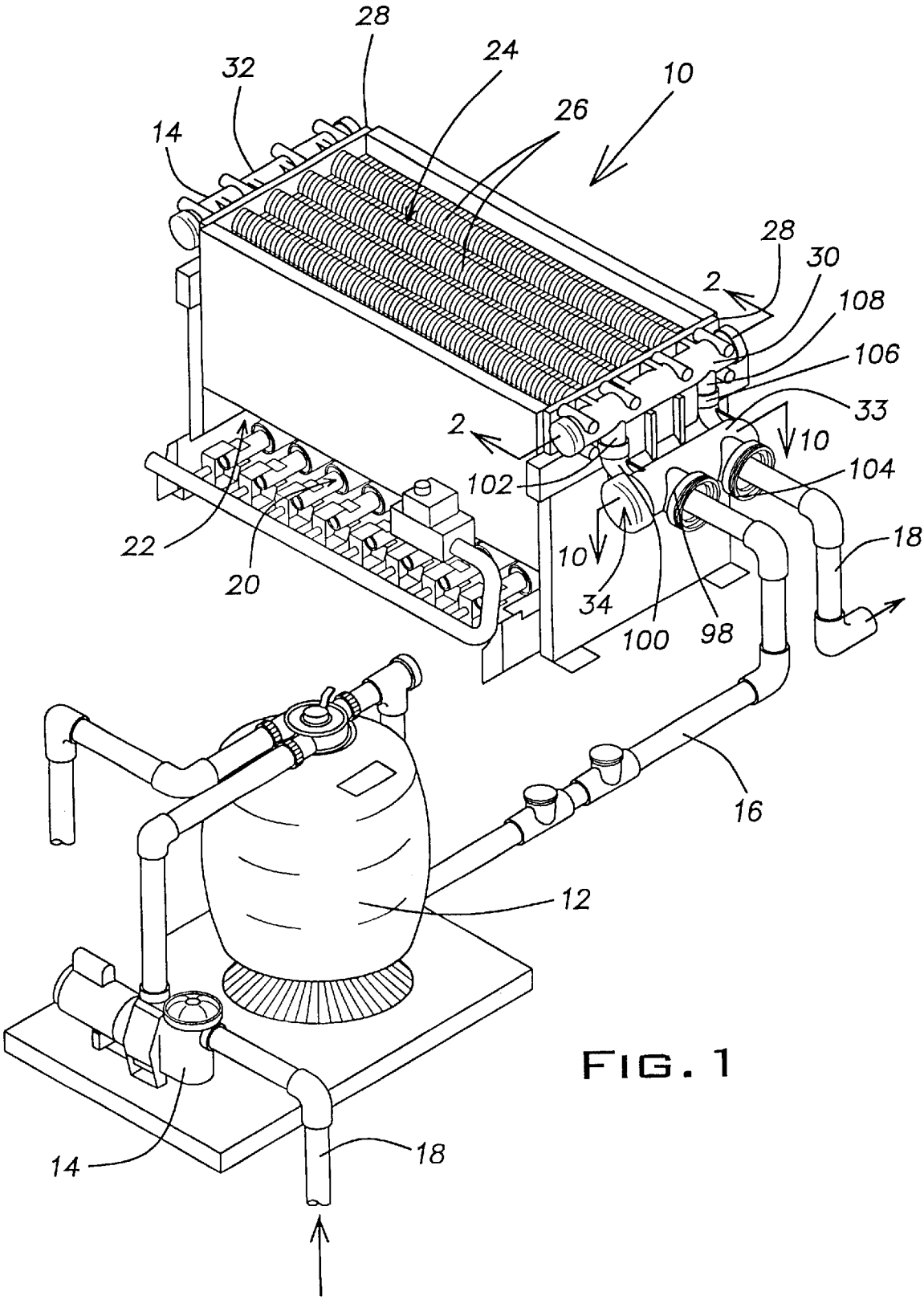
FIG. 1 is a perspective view of a swimming pool or spa heater of the present invention showing the heater connected to a conventional pump and filter.
Figure 1A:
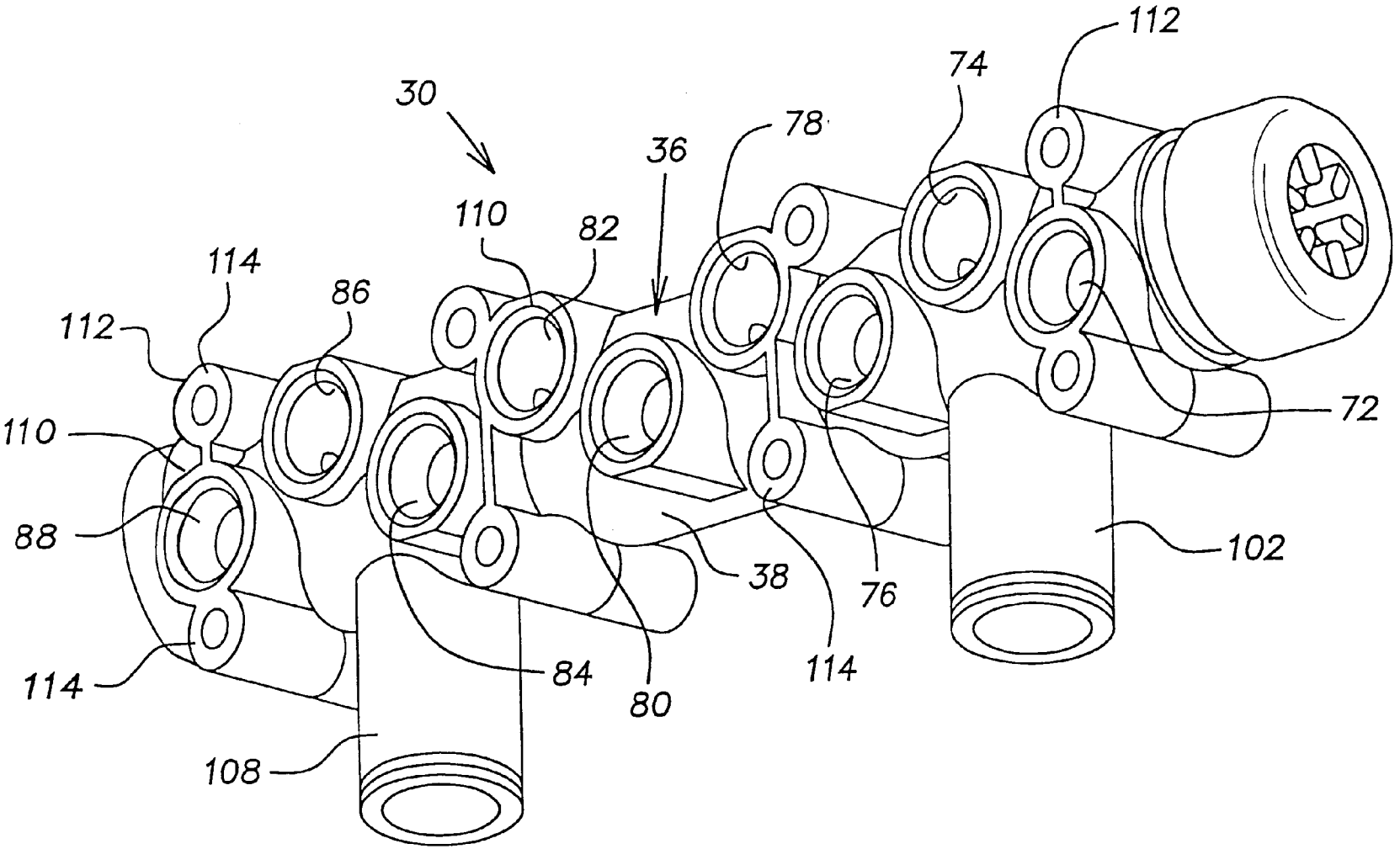
FIG. 1*a* is a perspective view showing a header manifold.
Figure 2:
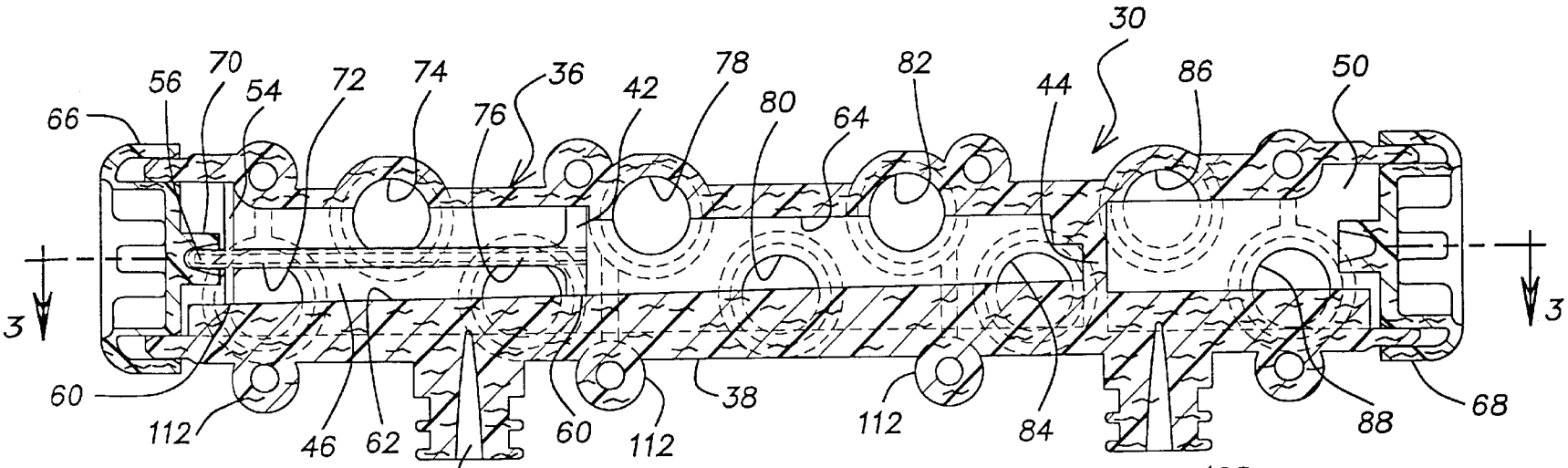
FIG. 2 is a cross-sectional view, the plane of the section being indicated by the line 2—2 in FIG. 1.
Figure 3:
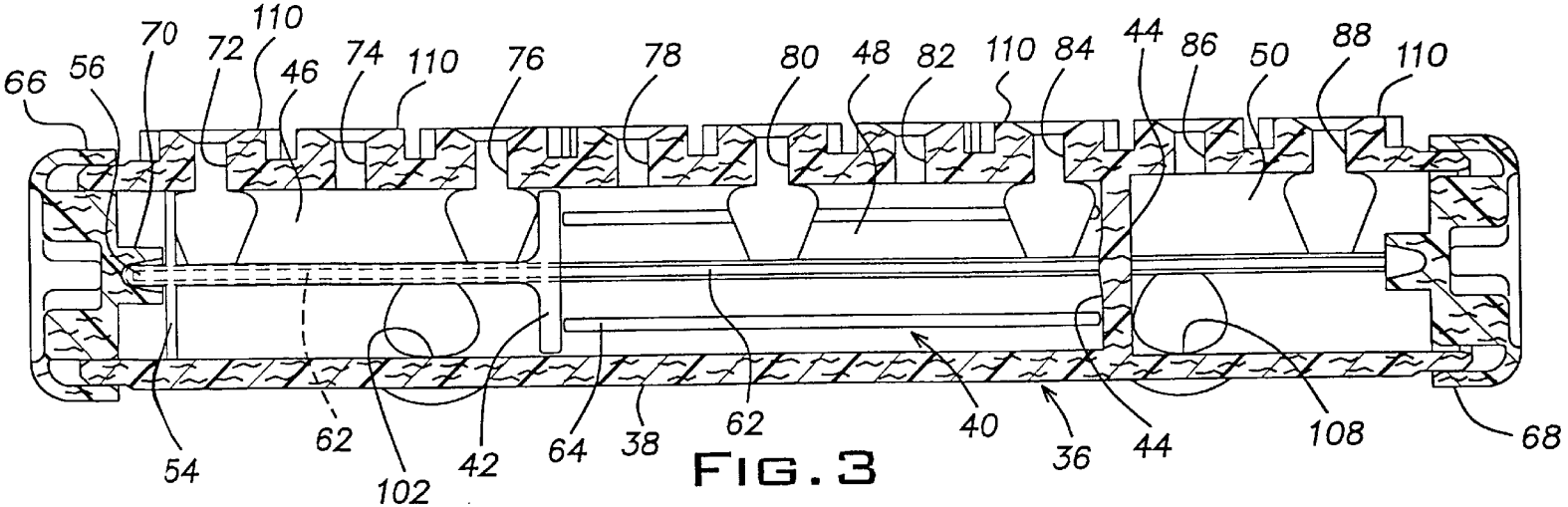
FIG. 3 is a cross-sectional view, the plane of the section being indicated by the line 3—3 in FIG. 2.
Figure 6:
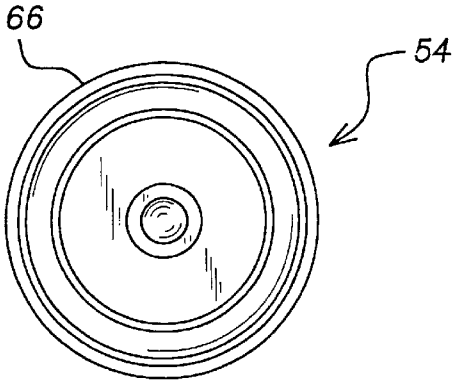
FIG. 6 is a right side elevational view of the manifold end cap.
Figure 5:
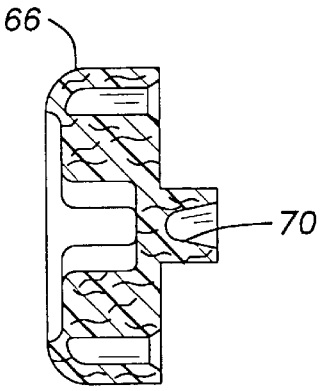
FIG. 5 is a cross-sectional view, the plane of the section being indicated by the line 5—5 in FIG. 4.
Figure 4:
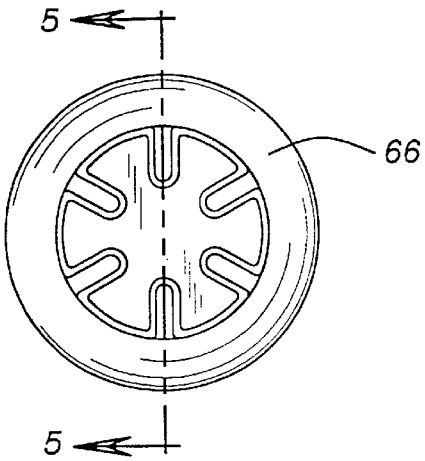
FIG. 4 is a left side elevational view of a manifold end cap.
Figure 9:
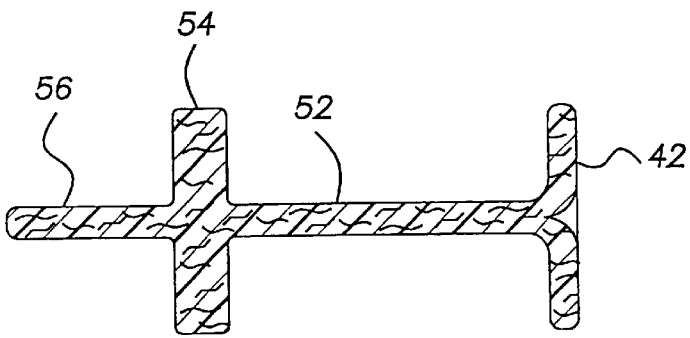
FIG. 9 is a cross-sectional view, the plane of the section being indicated by the line 9—9 in FIG. 8.
Figure 8:
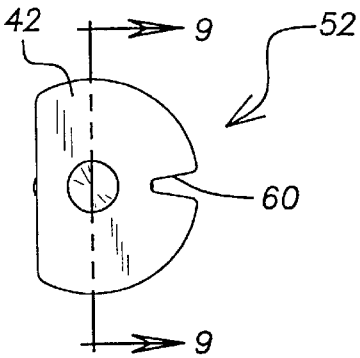
FIG. 8 is a right elevational view of the plug.
Figure 7:
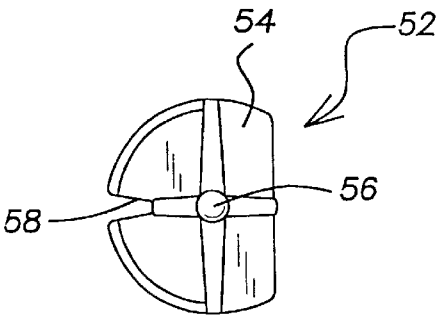
FIG. 7 is a left elevational view of a plug contained in the manifold header.

Referring now to the drawings and particularly to FIG. 1, there is illustrated a swimming pool or spa heater 10 connected to a conventional filter 12 and pump 14 by a piping conduit 16. Water is drawn from the pool or spa by a piping conduit 18 and is fed by the pump 14 through the filter to the heater 10.

The heater 10 includes a gas burner 20 mounted in the lower portion of a combustion chamber 22, a heat exchanger 24 comprising a plurality of parallel hollow tubes 26 extending horizontally within the combustion chamber 22 above the burner 20. The tubes 26 are mounted between a pair of flat mounting plates 28 and define a plurality of passageways through the plates. The heater 10 is enclosed within a shroud (not shown) having louvers in its top, front, rear and side walls to provide air ventilation for the heater 10.

The heater 10 further includes a manifold header 30 in fluid communication with one end of each tube 26 and a return header 32 in fluid communication with the other end of each tube 26. A main manifold 34 connects the manifold header 30 to the conduits 16 and 18 which comprise the fluid inlet and outlet, respectively, to and from the heat exchanger 24.

Referring to the manifold header 30 in greater detail and with particular reference to FIGS. 1*a*–8, the header 30 comprises a cylindrical or tubular, elongated body portion 36 having an outer surface 38 and an interior cavity 40. Interior partitions 42 and 44 separate the cavity 40 into a feed chamber 46, a return chamber 48, and an exit chamber 50.

The manifold header 30 is an injection molded, glass fiber reinforced plastic, such as PBT. Since the header 30 is injection molded, the partition 42 is assembled into the body portion 36 after the molding operation. The partition 42 is disc shaped and is formed at one end of a rod 52. An end or supporting partition 54 is formed adjacent the other end 56 of the rod 52. The partitions 42 and 54 are provided with aligned notches 58 and 60 which receive an axially extending rib 62 molded into the interior cavity 40. The partition 42 is butted against ribs 64 provided in the return chamber 48. End caps 66 and 68 are spun welded by conventional techniques to the ends of the body portion 36 to seal the ends of the interior cavity 40. It may be noted that the end cap 66 has a recessed axial projection 70 which receives the rod end 56 to securely locate the partitions 42 and 54.

The manifold header 30 is provided with a number of tube connecting hollow ports 72–88 corresponding to the number of tubes 26 in the heat exchanger, nine in the present embodiment. In order to provide desirable air flow between the tubes 26 while conserving space, the tubes 26, and accordingly, the ports 72–88, are arranged in two axially horizontally arranged rows with the respective ports of each row being offset relative to one another.

The hollow ports 72–88 project from the outer surface 38 and have annular end faces 110 which are sealed against the plate 28 to provide fluid communication between the fluid passages of the hollow tubes and the header 30. The hollow ports 72–88 contact the plate 28 in zones which immediately surround the tubes so that the zone of contact is cooled by the fluid passing through the tube since the temperature of that fluid is less than the temperature of the plate in more remote areas. Also, the projecting ports tend to space the tubular body portion 36 of the header 30 from the plate 28 to avoid conductive heating of the body portion 36 by the plate 28.

The manifold header 30 is provided with a plurality of parallel hollow bosses 112 which project substantially tangentially from the tubular body portion 36 of the header 30 and which have plate-engaging faces 114 substantially coplanar with the end faces 110 of the ports 72–88. Bolts (not shown) extend through the hollow bosses 112 to affix the header 30 to the plate 28.

The bosses 112 are located in closely spaced adjacency to the ports 72–88 so that minimal heat is transferred to the header 30.

Figure 10:
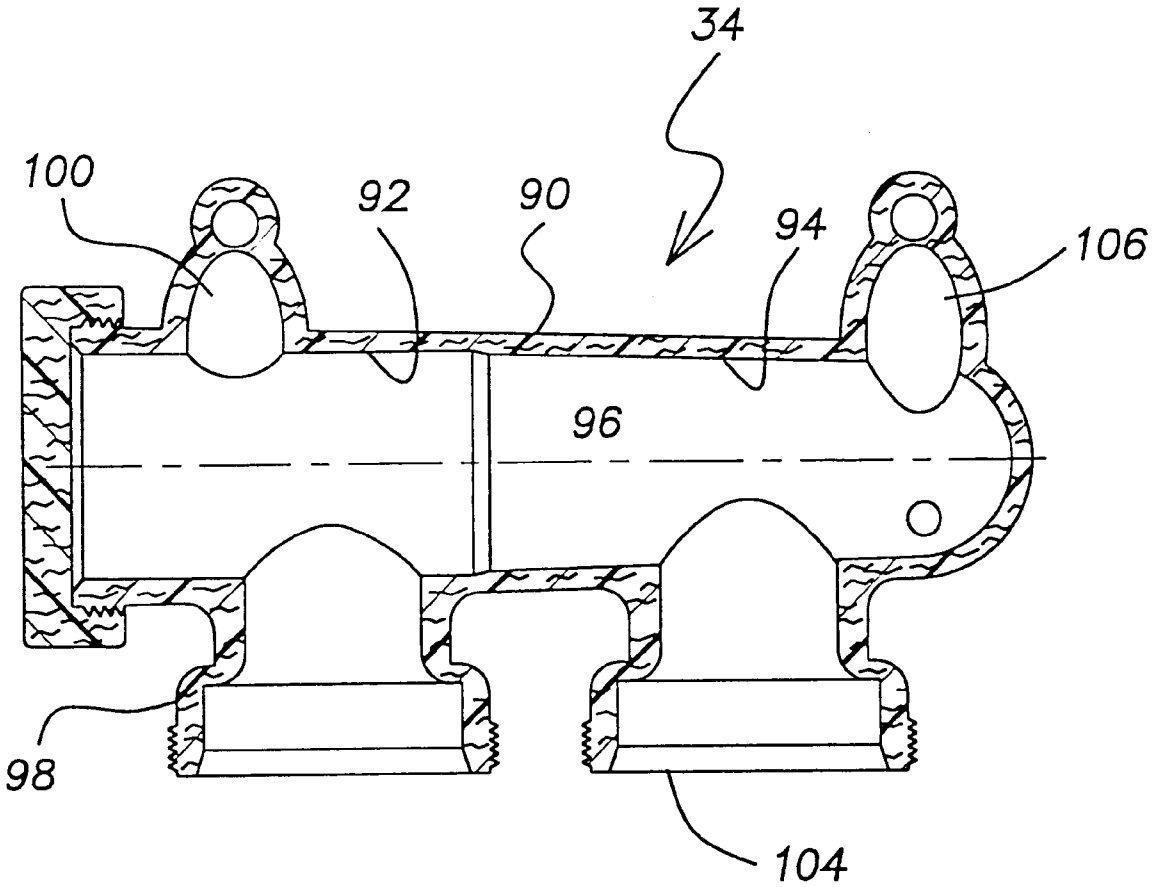
FIG. 10 is a cross-sectional view, the plane of the section being indicated by the line 10—10 in FIG. 1.

The main manifold 34 feeds fluid to and receives fluid from the manifold header 30. The main manifold 34 (FIGS. 1 and 10) is injection molded from engineered resin and may be reinforced with glass fibers. The manifold 34 includes a hollow body portion having an internal inlet and outlet chambers 92 and 94, respectively, defined by a partition 96. The inlet chamber 92 has inlet and outlet ports 98 and 100, respectively, connected to the conduit 16 and an inlet port 102 provided in the manifold header 30. Similarly, the outlet chamber 94 has inlet and outlet ports 104 and 106, respectively, connected to the conduit 18 and an outlet port 108 provided in the manifold header 30.

Figure 11:
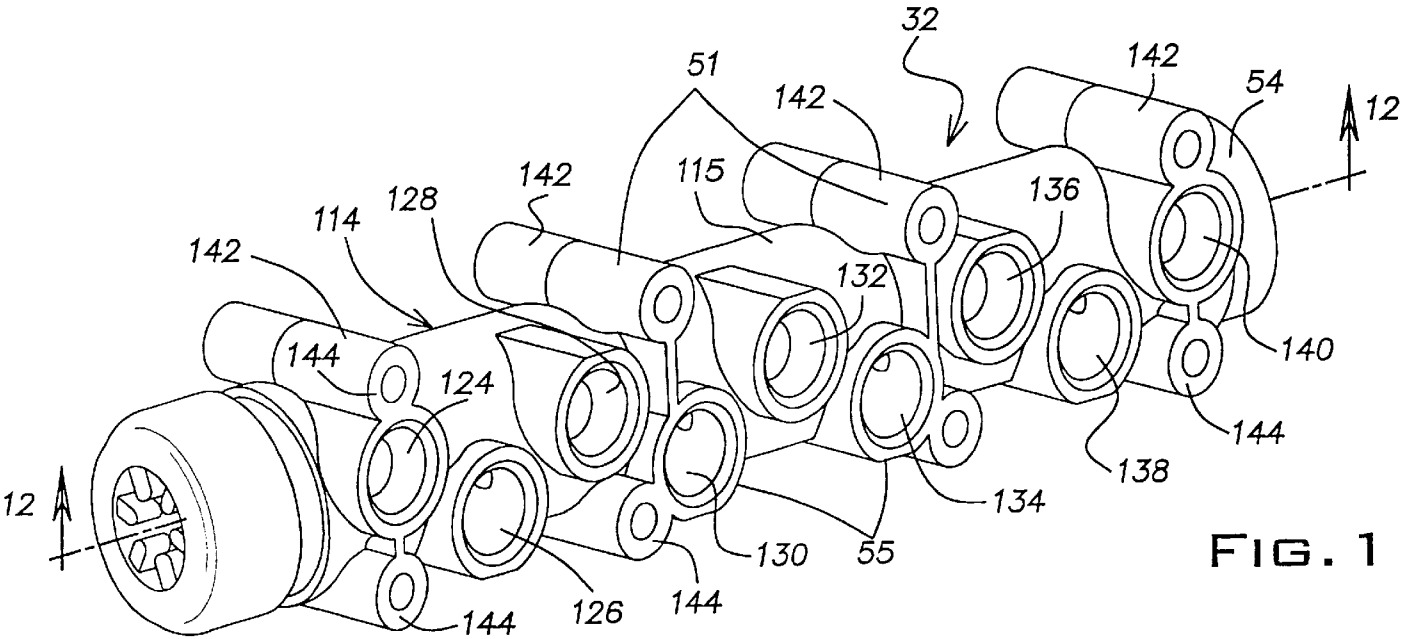
FIG. 11 is a perspective view showing a return manifold.
Figure 12:
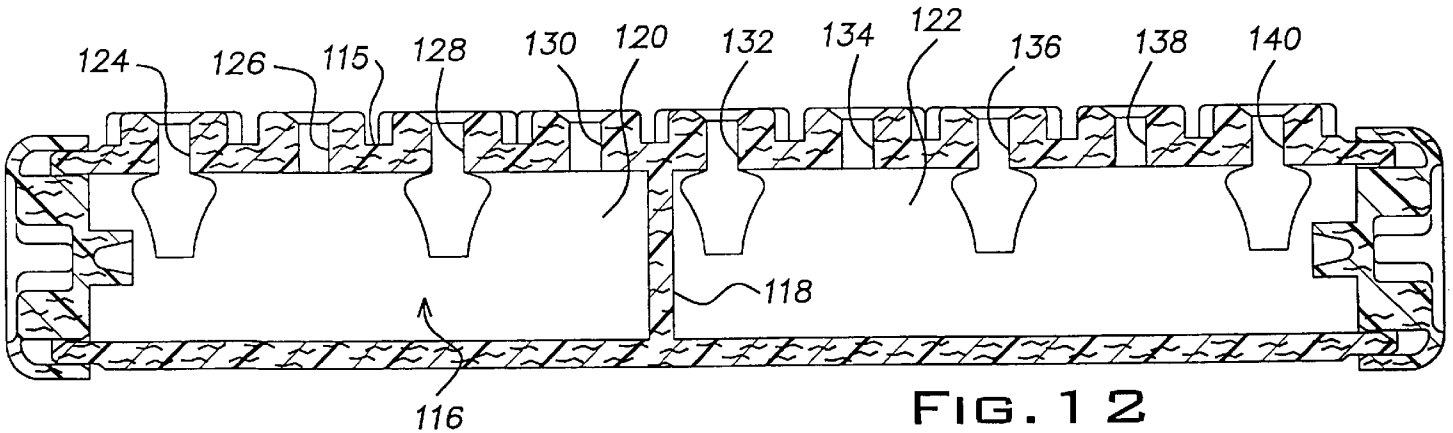
FIG. 12 is a cross-sectional view, the plane of the section being indicated by the line 12—12 in FIG. 11.
Figure 13:
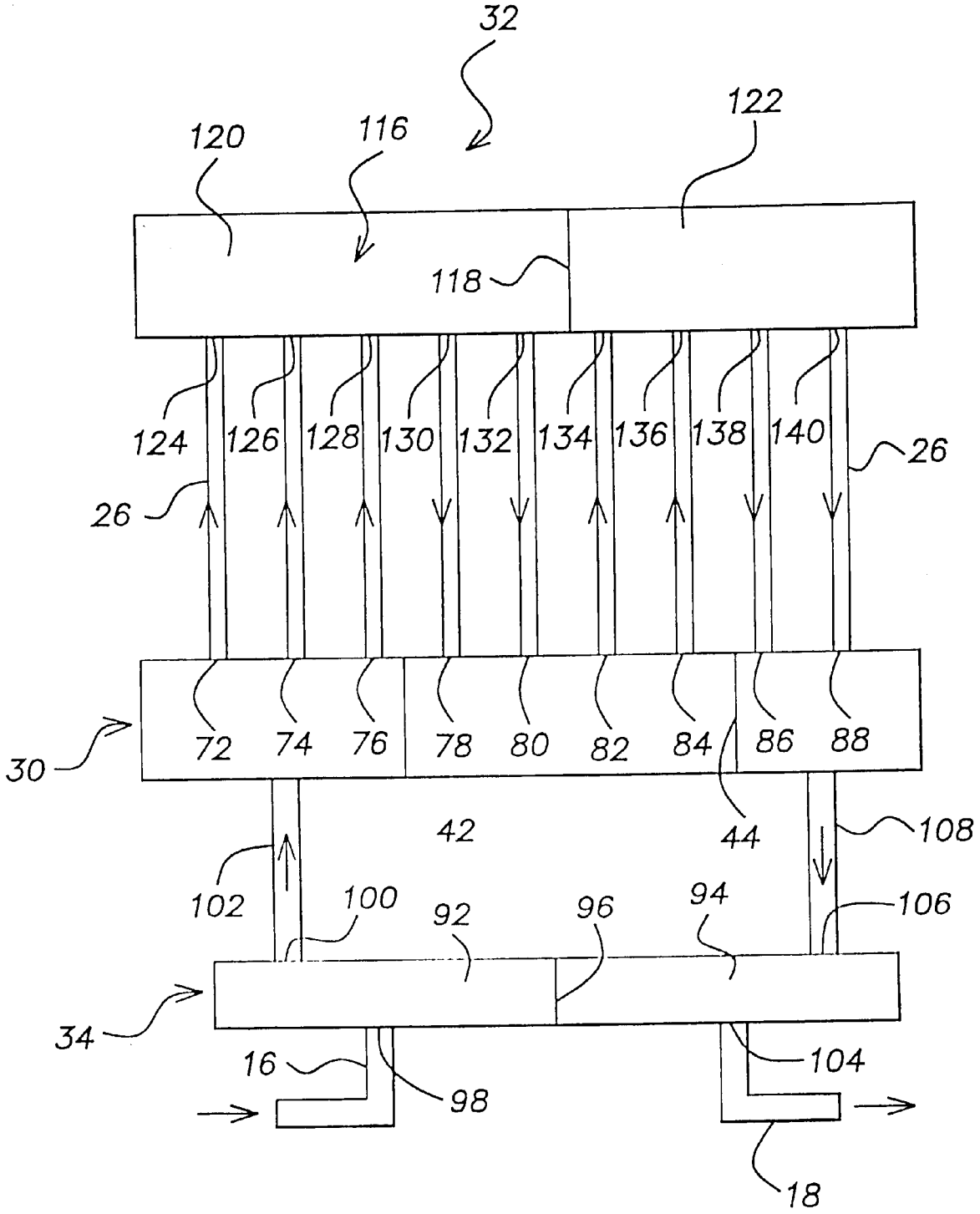
FIG. 13 is a schematic representation of the flow path of heat exchanging fluid through the heat exchanger.

Referring now to FIGS. 11 and 12, the return header 32 is constructed of fiber-reinforced plastic and compresses a cylindrical or tubular body portion 114 having an outer surface 115 and an internal cavity 116. An internal partition 118 separates the cavity into a first chamber 120 and a second chamber 122. As may be particularly noted with reference to FIG. 13, the first chamber 120 is connected by the heat exchanger tubes 26 to the return chamber 48 and the exit chamber 50 of the manifold header 30.

The body portion 114 of the return header 32 has a plurality of parallel, hollow ports 124–140 projecting from its outer surface 115 which are sealed to the other one of the tube mounting plates 28 to provide fluid communication between the fluid passages of the hollow tubes 26 and the cavity 116. The hollow ports 124–140 contact the plate 28 in zones immediately surrounding the tubes 26 so that the zone of contact is cooled by the fluid passing through the tube, since the temperature of the fluid is less than the temperature of the plate 26 in more remote areas. Also, the projecting ports 124–140 tend to space the tubular body portion 114 from the plate 28 to avoid conductive heating of the body portion 114 by the plate 28.

The return header 32 is also provided with a plurality of parallel, hollow bosses 142 which project tangentially from the tubular body portion 114 and which have plate-engaging faces of the projecting ports 124–140. Bolts (not shown) extend through the hollow bosses to affix the header 32 to the plate 28. The bosses 142 are located in closely spaced adjacency to the ports 124–140 so that minimal heat is transferred to the header.

While the invention has been shown and described with respect to particular embodiments thereof, those embodiments are for the purpose of illustration rather than limitation, and other variations and modifications of the specific embodiments herein described will be apparent to those skilled in the art, all within the intended spirit and scope of the invention. Accordingly, the invention is not to be limited in scope and effect to the specific embodiments herein described, nor in any other way that is inconsistent with the extent to which the progress in the art has been advanced by the invention.

What is claimed:

1. In combination with a water heater having a heat exchanger, a header for said heat exchanger, said heat exchanger having a plurality of parallel hollow tubes mounted between a pair of flat mounting plates and defining a plurality of fluid passages through said plates, said header comprising an elongated body portion having a continuous outer surface and a closed interior cavity, said body portion having a plurality of parallel hollow ports communicating with said cavity, projecting from its outer surface and being adapted to be sealed against one of said plates to provide fluid communication between said passages and said cavity and being further adapted to space said outside surface from said plates, said header being a polymer.

2. The water heater according to claim 1 wherein said polymer is a fiber reinforced composite.

3. The water heater according to claim 2 wherein said fiber is glass.

4. The water heater according to claim 1 wherein said body portion has a plurality of parallel hollow bosses projecting therefrom and adapted to receive bolts for affixing said header to said one of said plates.

5. The water heater according to claim 1 wherein an interior partition separates said cavity into a feed chamber and a return chamber.

6. The water heater according to claim 1 wherein a pair of interior partitions separate said cavity into a feed chamber, a return chamber, and an exit chamber.

7. The water heater according to claim 1 wherein said elongated body portion is cylindrical.

8. The water heater according to claim 1 including end closures for said interior cavity, said end closures comprising end caps spun welded to said body.

9. The water heater according to claim 6 wherein a first one of said partitions is a wall integrally formed by said body portion and a second one of said partitions comprises a disc formed at one end of a rod.

10. The water heater according to claim 9 wherein said disc has a notch therein which slideably receives a longitudinal rib formed in said interior cavity.

11. The water heater according to claim 10 wherein said disc is butted against at least one rib formed in said return chamber.

12. A water heater comprising a burner unit, means defining a combustion chamber above said burner unit, and a heat exchanger within said combustion chamber, said heat exchanger comprising a plurality of parallel tubes having ends extending through a pair of flat mounting plates, a manifold header in fluid communication with one end of each tube, and a return header in fluid communication with another end of each tube, said manifold header comprising an elongated body portion having a continuous outer surface and a closed interior cavity, said body portion having a plurality of parallel hollow ports communicating with said cavity, projecting from its outer surface, and being sealed against one of said plates to provide fluid communication between said passages and said cavity and to space said outside surface from one of said plates, said manifold header and said return header being a polymer.

13. The water heater according to claim 12 wherein said polymer is a fiber reinforced composite.

14. The water heater according to claim 13 wherein said fiber is glass.

15. The water heater according to claim 12 wherein said body portion has a plurality of parallel hollow bosses projecting therefrom and receiving bolts affixing said manifold header to said one of said plates.

16. The water heater according to claim 12 wherein a pair of interior partitions separate said cavity into a feed chamber, a return chamber, and an exit chamber.

17. The water heater according to claim 12 wherein said elongated body portion is cylindrical.

18. The water heater according to claim 16 wherein a first one of said partitions is a wall integrally formed by said body portion and a second one of said partitions comprises a disc formed at one end of a rod.

19. The water heater according to claim 18 wherein said disc has a notch therein which slideably receives a longitudinal rib formed in said interior cavity and wherein said disc is butted against at least one rib formed in said return chamber.

20. The water heater according to claim 12 wherein said return header comprises an elongated body portion having an outer surface and an interior cavity, said body portion having a plurality of parallel hollow ports projecting from its outer surface and being sealed against another one of said plates to provide fluid communication between said passages and said cavity and to space said outside surface from said another one of said plates.

21. The water heater according to claim 20 wherein the body portion of said return header has a plurality of parallel hollow bosses projecting therefrom and receiving bolts affixing said return header to the other one of said plates.

22. A water heater comprising a burner unit, means defining a combustion chamber above said burner unit, and a heat exchanger within said combustion chamber, said heat exchanger comprising a plurality of parallel tubes having ends extending through a pair of flat mounting plates, a manifold header in fluid communication with one end of each tube, and a return header in fluid communication with another end of each tube, said manifold header and said return header comprising an elongated body portion having a continuous outer surface and a closed interior cavity, each said body portion having a plurality of parallel hollow ports communicating with said cavity projecting from its outer surface and being sealed against each of said plates to provide fluid communication between said passages and each said cavity and to space each said outside surface from each of said plates, said manifold header and said return header being a polymer.

23. The water heater according to claim 22 wherein the manifold header is provided with a pair of interior partitions separating its cavity into a feed chamber, a return chamber, and an exit chamber, wherein the return header is provided with an interior partition separating its cavity into a feed chamber and a return chamber, and wherein at least one of said tubes provides fluid communication between each feed chamber, at least one of said tubes provides fluid communication between the feed chamber of the return manifold and the return chamber of the header manifold, at least one of said tubes provides fluid communication between the return chamber of the header manifold and the return chamber of the return manifold, and at least one of the tubes provides fluid communication between the return chamber of the return manifold and the exit chamber of the header manifold.

24. The water heater according to claim 23 including a main manifold having a hollow body separating into inlet and outlet chambers by a partition, said inlet and outlet chambers each being provided with inlet and outlet ports, the outlet port of said inlet chamber being connected to the feed chamber of the manifold header, the inlet port of the inlet chamber being adapted to be connected to a filter, the inlet port of said outlet chamber being connected to the exit chamber of said manifold header, and the outlet port of said outlet chamber being adapted to be connected to a swimming pool or spa.

25. A header for a heat exchanger having a plurality of parallel hollow tubes mounted between a pair of flat mounting plates defining a plurality of fluid passages through said plates; said header comprising an elongated body portion having an outer surface and an interior cavity; a pair of interior partitions separating said cavity into a feed chamber, a return chamber, and an exit chamber; a first one of said partitions comprising a wall integrally formed by said body portion; a second one of said partitions comprising a disc formed at one end of a rod; said body portion having a plurality of parallel hollow ports projecting from its outer surface and being adapted to be sealed against one of said plates to provide fluid communication between said passages and said cavity and being further adapted to space said outside surface from said plates, said header being a polymer.

26. The header according to claim 25, wherein said disc has a notch therein which slideably receives a longitudinal rib formed in said interior cavity.

27. The header according to claim 26 wherein said disc is butted against at least one rib formed in said return chamber.

28. The water heater comprising a burner unit, means defining a combustion chamber above said burner unit, and a heat exchanger within said combustion chamber, said heat exchanger comprising a plurality of parallel tubes having ends extending through a pair of flat mounting plates, a manifold header in fluid communication with one end of each tube, and a return header in fluid communication with another end of each tube, said manifold header comprising an elongated body portion having an outer surface and an interior cavity, a pair of interior partitions separating said cavity into a feed chamber, a return chamber, and an exit chamber, a first one of said partitions comprising a wall integrally formed by said body portion and a second one of said partitions comprising a disc formed at one end of a rod.

29. The water heater according to claim 28, wherein said disc has a notch therein which slideably receives a longitudinal rib formed in said interior cavity and wherein said disc is butted against at least one rib formed in said return chamber.

* * * * *